United States Patent [19]

Knight et al.

[11] 3,980,168

[45] Sept. 14, 1976

[54] METHOD AND APPARATUS FOR AUTHENTICATING AND IDENTIFYING COINS

[76] Inventors: Michael John Knight, 18c Lincoln Hatch Lane, Burnham, Buckinghamshire, England; Gérard Cuénod, 11B Chemin des Senailles, Grand-Nancy, Geneva, Switzerland; Louis Marius Andre Bechet, 49 re de Romagny, Annemasse, France

[22] Filed: July 9, 1975

[21] Appl. No.: 594,298

Related U.S. Application Data

[63] Continuation of Ser. No. 405,557, Oct. 11, 1973, abandoned.

[30] Foreign Application Priority Data

Oct. 12, 1972 United Kingdom ..... 47162/72

[52] U.S. Cl. ..... 194/100 A; 209/111.8

[51] Int. Cl.[2] ..... G07F 3/02

[58] Field of Search ..... 194/99, 100, 100 A, 194/101; 73/163; 209/81 A, 111.8; 324/34 RS

[56] References Cited

UNITED STATES PATENTS

| | | | |
|---|---|---|---|
| 1,972,097 | 9/1934 | Hoban | 194/101 |
| 3,193,075 | 7/1965 | Okolischan et al. | 209/111.8 UX |
| 3,349,323 | 10/1967 | Mullen | 324/34 RS |
| 3,556,276 | 1/1971 | Pennell | 194/101 |
| 3,701,405 | 10/1972 | Fougere | 194/101 |
| 3,797,307 | 3/1974 | Johnston | 194/100 A X |

*Primary Examiner*—Robert B. Reeves
*Assistant Examiner*—Francis J. Bartuska
*Attorney, Agent, or Firm*—Davis, Hoxie, Faithfull & Hapgood

[57] ABSTRACT

In a coin selector, a coin moving in a nearly vertical path under the influence of gravity is first tested to determine whether it is made of a ferromagnetic or non-ferromagnetic, conductive material. If the coin is identified as one of ferromagnetic material, it is further identified by examining a function of one of the coin's dimensions and by timing the period necessary for it to travel through a solenoid. If the coin is identified as of a non-ferromagnetic, conductive material, it is further identified by examining a function of one of the coin's dimensions and timing the period necessary for it to travel through a linear motor which is arranged to decelerate such moving coins.

15 Claims, 5 Drawing Figures

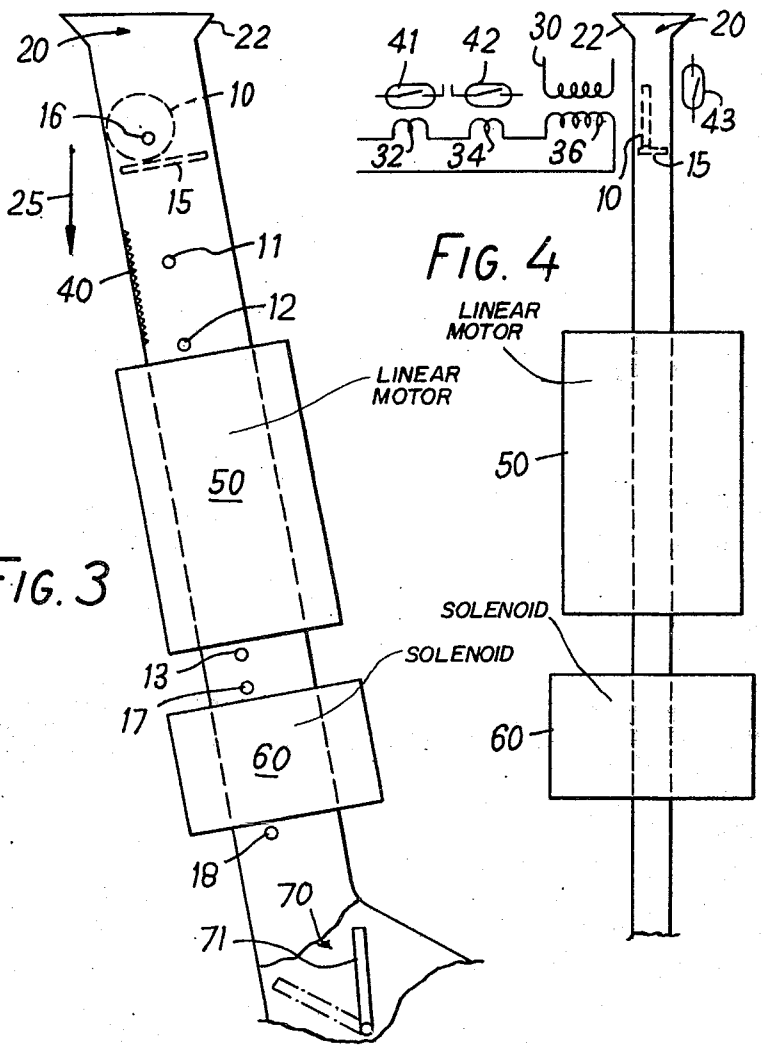
FIG. 4
FIG. 3
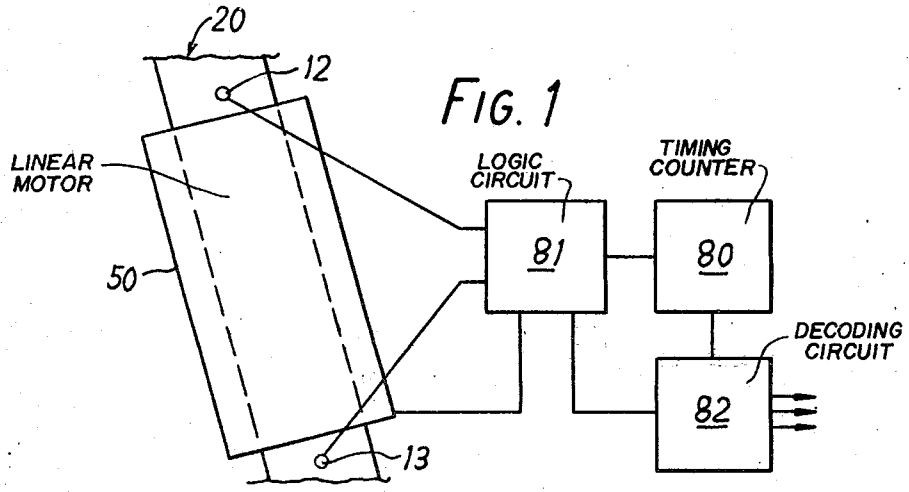
FIG. 1
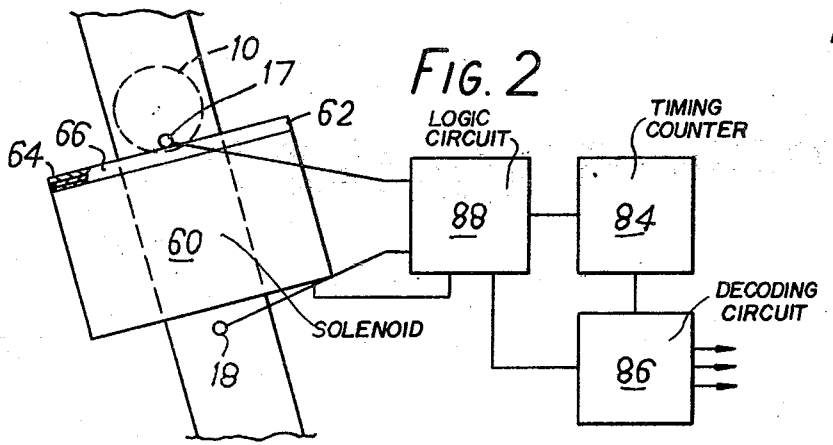
FIG. 2

METHOD AND APPARATUS FOR AUTHENTICATING AND IDENTIFYING COINS

This application is a continuation of application Ser. No. 405,557, filed Oct. 11, 1973 now abandoned.

This invention relates to coin testing and, more particularly, to a method and apparatus for authenticating and identifying coins.

According to the present invention in one aspect there is provided a method of testing coins in which the coin is allowed to fall down a nearly vertical coin passageway, a travelling magnetic field is generated in the passageway, the field travelling up the passageway, and the velocity of the coin subjected to the magnetic field is examined.

According to the present invention in another aspect there is provided a device for testing coins including a nearly vertical passageway down which coins can pass, an impeller comprising means for generating a travelling magnetic field, the field travelling up the passageway, and means for examining the velocity of a coin subjected to the travelling magnetic field.

In one form of the invention, a coin sliding down a steeply sloping coin passageway is first tested to determine whether it is magnetic or non-magnetic. If found to be magnetic, the coin is identified by examining a function of its physical size (e.g. a chord or diameter of its face) and timing its travel through a solenoid disposed around or near the coin passageway and arranged to decelerate the motion of a magnetic coin along the passageway. If found to be non-magnetic, the coin is identified by examining a function of its size as above and timing its travel through a linear motor disposed around or near the coin passageway and arranged to decelerate the motion of a non-magnetic coin along the passageway. In the case of both magnetic and non-magnetic coins, the coin identification resulting from the measurement of physical size must match the coin identification resulting from the measurement of time of travel through either the solenoid or the linear motor. This increases the selectivity of the device and ensures that it cannot be cheated.

An embodiment of the invention will now be described, by way of example, with reference to the accompanying drawings, in which:

FIG. 1 is a schematic side view of a component of a coin testing device, for testing non-ferromagnetic conductive coins;

FIG. 2 is a schematic side view of a component of a coin testing device for testing ferromagnetic coins;

FIG. 3 is a schematic side view of a coin apparatus for ferromagnetic and non-ferromagnetic conductive coins;

FIG. 4 is a schematic front view of the apparatus of FIG. 3; and

Figure 5:
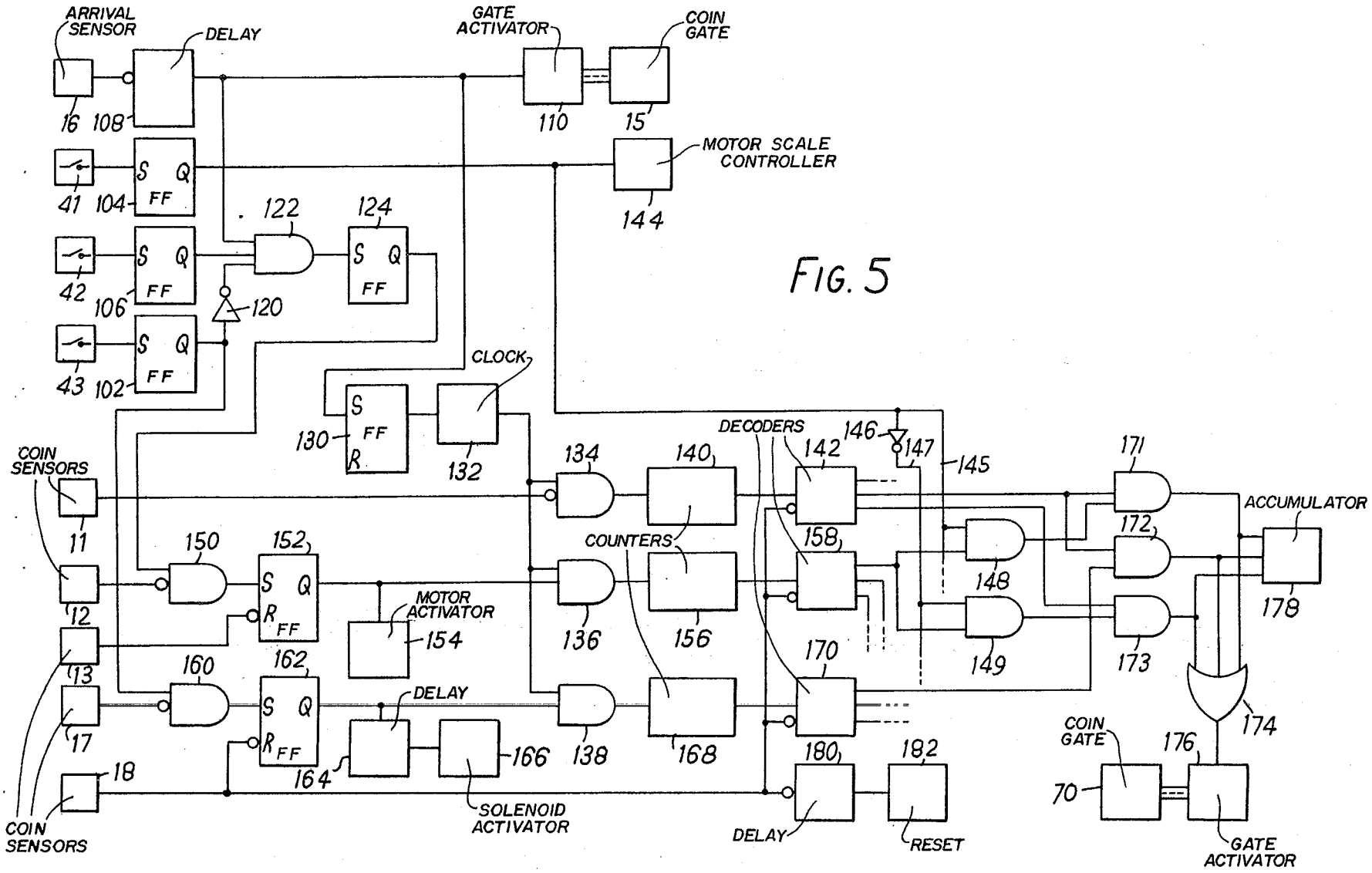
FIG. 5 is a schematic block circuit diagram of the device of FIGS. 3 and 4.

Throughout this specification the term "coin" is intended to mean genuine coins, tokens, counterfeit coins, slugs, washers, and any other item which may be used by persons in an attempt to use coin-operated devices. For simplicity, through this specification ferromagnetic coins are referred to as "magnetic" coins and non-ferromagnetic, conductive coins are referred to as "non-magnetic" coins.

FIG. 1 shows a component for testing non-magnetic coins which employs a linear motor 50 to retard coins and which examines the retardation to provide an indication of the properties of the coin and hence its denomination. As is well known, a linear motor is one in which the pole pieces, equivalent to the stator of a conventional motor, are arranged in line and energised by alternating currents with predetermined phase relationship between them to produce a travelling electromagnetic field along the line or axis of the motor. When an electrically conductive object is placed in the field, eddy currents are produced in the object which interact with the travelling magnetic field producing a force between the object and the linear motor.

U.K. Specification No. 1,319,126 discloses a coin testing device in which use of a linear motor is used as an impeller to accelerate coins and in which the velocity of the coins so impelled is examined to discriminate between them. In the present case a linear motor is used to decelerate a moving coin.

In the coin testing apparatus shown in part in FIG. 1, a linear motor 50 is positioned adjacent a coin passageway 20 between sensors 12 and 13. The linear motor 50 is arranged with its axis parallel to the direction of motion of coins along the passageway 20. Each of the pole pieces of the linear motor 50 preferably has a dimension in the direction of the axis of the motor less than the diameter of the smallest acceptable coin. This renders the effect of linear motor 50 on a passing coin essentially independent of the coin's diameter.

The effect of the linear motor 50 on the velocity of a coin is primarily dependent on the strength of the field of the motor B and on the product of the resistivity r and density d of the material of the coin. Assuming that the magnetic field strength B is known, the effect of linear motor 50 on the velocity of a coin provides a measure of the product of these two coin parameters. The extent of this effect is determined by measuring the time taken by the coin to travel through the linear motor 50 from the sensor 12 to the sensor 13. Alternatively, a function of the exit velocity from the linear motor 50 might be measured.

The coin presence sensors 12 and 13 are light-sensitive devices operating in conjunction with corresponding light sources (not shown) on the opposite side of the passageway 20. When the sensor 12 is first occluded by a coin 10, a logic circuit 81 detects the change in output of the sensor 12 and starts both the linear motor 50 and a timing counter 80. The linear motor 50 retards the coin 10 to an extent dependent on the strength of the linear motor and the product of the resistivity and density of the coin 10 as explained above. When the coin 10 first occludes the sensor 13 on the downstream side of the linear motor 50, the change in output signal of that sensor 13 is detected by a logic circuit 81 which de-energises the linear motor 50, stops the counter 80 and activates a decoding circuit 82. The circuit 82 compares the final pulse count of the counter 80 with predetermined ranges of corresponding pulse counts for acceptable coins of several denominations and produces a coin-identifying output signal on output leads associated with any denomination for which the range of pulse counts includes the final pulse count of the coin being tested.

FIG. 2 shows a component for testing magnetic coins which employs an electromagnet in this case a solenoid 60 which is arranged to retard a moving coin passing through its field, and means for examining the retardation of the coin which is dependent on the coin's properties. By the various arrangements described below, the coin is subjected to deceleration by the magnetic field of the solenoid but substantial magnetic acceleration as it approaches the solenoid is either avoided or the retardation is so examined that any acceleration does not cancel the effect of the retardation in the measurements.

The timing technique for the apparatus of FIG. 2 is similar to that of FIG. 1. When the sensor 17 is first not occluded after a period of occlusion by a coin 10, a logic circuit 88 detects the change in output of the sensor 17 and both energises the solenoid 60 and starts a timing counter 84. The solenoid 60 retards the coin 10 to an extent dependent on the strength of the solenoid's field and the magnetic susceptibility and density of the coin 10. When the sensor 18, on the other side of the solenoid 60 is first not occluded after a periof of occlusion by the coin 10, the change in output signal of that sensor 18 is detected by the logic circuit 88 which turns off the solenoid 60, stops the counter 84 and activates a decoding circuit 86. The decoding circuit compares the final pulse count of the counter 84 with predetermined range of pulse counts for acceptable coins of several denominations and produces a coin-identifying output signal on output leads associated with any denomination of coin for which the range of pulse counts includes the final pulse count for the coin under test.

Alternatively, the logic circuit may be responsive to signals occurring when the sensors 17 and 18 are first occluded. A delay in activation of the solenoid 60 from the time of first occlusion of sensor 17 is employed to permit the coin to be within the field when the solenoid 60 is activated so that the coin is first acted upon by a substantial net decelerating force, and any acceleration of the coin by the magnetic field as it approaches the solenoid is avoided.

Another way of reducing the acceleration of the coin 10 by the solenoid 60 as it enters the magnetic field, which partially cancels the effect of the deceleration by the magnetic field, is to shield one end of the solenoid 60. This reduces the fringe field of the solenoid 60 which has a significant effect on the velocity of the coin 10. For example, the solenoid 60 can be shielded with a shield 62 of soft iron laminae 64 transverse to the solenoid axis at the upper end of the solenoid 60, with a rectangular hole 66 aligned with the axis of the solenoid 60 to permit the passage of coins.

A third way of reducing the effect of any acceleration by the magnetic field as the coin approaches the solenoid 60 is to measure the velocity of the coin by timing its passage from a point within the solenoid's field to a point outside of the field; for example, by locating one sensor at or near the centre of the field, and the other at the downstream end of the field. This way is theoretically not as satisfactory as the preceding ones, because it does not avoid an increase in the coin's velocity as it enters the field of the solenoid.

In the schematic representation of the coin testing device shown in FIGS. 3 and 4, a coin 10 is introduced into a coin passageway 20 by way of coin entry 22. The coin 10 falls down the passageway under the influence of gravity, coming to rest against a coin starting gate 15 in the position shown. The coin entry 22 is designed to permit entry only to those coins or other objects small enough to pass easily through the coin passageway 20. The coin passageway 20 is steeply sloping or nearly vertical so that coins pass through the coin testing device under conditions closely approximating those of free fall. In FIGS. 3 and 4, the direction of the force of gravity is indicated by arrow 25. In the particular embodiment shown in FIGS. 3 and 4 coin passageway 20 deviates slightly from the vertical so that the coin 10 falls down the passageway with its edge in contact with one interior surface of the passageway. In this way the path of the coin 10 through coin passageway 20 is precisely defined without causing the coin 10 to rotate (except in certain cases in the vicinity of a rack 40 as will be discussed in detail below). In addition, the internal dimensions and surface materials of the coin passageway 20 are chosen so that coins pass through the passageway with the minimum of vibration and frictional resistance. The gate 15 momentarily halts all coins introduced into passageway 20, thereby ensuring that all coins start their passage through the remainder of passageway 20 from rest. The gate 15 may be any retractable obstruction in the passageway 20, for example, a spring-loaded pin or plate extending through one wall into the passageway 20 and retracted by a solenoid (not shown).

As the coin 10 approaches the coin starting gate 15, it passes through an electromagnetic field set up in the passageway 20 by a coil 30. The coil 30 is driven by a low frequency alternating current source (not shown). The electromagnetic field produced by the coil 30, located on one side of the passageway 20, is normally strong enough to keep the contacts of a reed-delay switch 43, located on the other side of passageway 20, closed. When a magnetic coin 10 (i.e. a coin made of a ferro-magnetic material such as iron or nickel) passes between the coil 30 and the contacts of the relay switch 43, however, the coin magnetically shields from the coil 30 the relay switch 43 permitting its contacts to open momentarily. A non-magnetic coin (e.g. a copper or aluminium coin) does not shield coil 30 in this way and therefore does not cause relay 43 to open.

The relay switch 43 is connected to a terminal of the logic circuit shown schematically in FIG. 5. A bistable flip-flop device 102, which is normally in a reset condition, responds to the opening of the relay switch 43 by changing to a set condition. Accordingly, after the coin 10 has passed the coil 30, the condition of the flip-flop 102 indicates whether the coin is magnetic or non-magnetic.

A coil 36 is used to provide a preliminary indication of the electrical resistivity of the material of coin 10. When the coin 10 passes through the field of the coil 36, it modifies the relatively high frequency alternating current (e.g. 75 kHz) in the coil in dependence on the resistivity of the coin. The frequency of the current driving coil 36 is preferably high enough for the interaction with coin 10 to be limited to the surface of the coin 10 nearest the coil 36.

In this way the measurement of resistivity is not influenced by the thickness of coin 10. In addition, the coil 36 is preferably small enough for the diameter of coin 10 not to affect the measurement of resistivity.

Measurement of the change of current in the coil 36 as a result of the interaction with the coin 10 is made by electromagnetic relays (e.g. reed relays) 41 and 42, the windings 32 and 34 of which are connected in series with coil 36 as shown in FIG. 4. Normally, the contacts of both of these relays remain open. When a metal object of relatively high resistivity passes through the field of the coil 36, sufficient current flows in the coil 36 to cause the relay 42 to close momentarily. When a metal object of relatively low resistivity passes through the field of coil 36, a larger current flows in the coil 36 causing both relays 41 and 42 to close momentarily. The relay 42 is designed to close in response to a smaller current than the relay 41.

The relays 41 and 42 are connected to bistable flip-flops 104 and 106 in the circuit of FIG. 5. Each of the normally reset flip-flops 104 and 106 is set by the momentary closing of the associated relay. After an object has passed through the field of the coil 36, the condition of flip-flops 104 and 106 provide an indication of the resistivity of the object as illustrated by the following table:

| LOGICAL CONDITION OF FLIP-FLOP 104 | LOGICAL CONDITION OF FLIP-FLOP 106 | TYPE OF OBJECT |
|---|---|---|
| RESET | RESET | Object of very high resistivity (e.g. non-metallic object). |
| RESET | SET | Metallic object of relatively high resistivity |
| SET | SET | Metallic object of relatively low resistivity. |

The condition of the flip-flop 106 indicates whether an object is metallic or non-metallic. Given that an object is metallic, the condition of the flip-flop 104 indicates whether it is of relatively high or reltively low resistivity. This latter indication is used to determine the strength at which it is best to operate the linear motor 50 in order to identify a coin in the manner described in greater detail below.

In the coin testing apparatus of FIGS. 3 and 4 a preliminary determination of coin resistivity is made by the relay 41 as described above. The result of this determination is recorded by the flip-flop 104 which is in the reset condition for coins of relatively high resistivity. The output signal of the flip-flop 104 is applied to a linear motor scale controller 144. When the flip-flop 104 is reset, the scale controller 144 presets linear motor 50 for high strength operation, e.g. by presetting motor 50 for connection to a relatively high current power source (not shown). On the other hand, when the flip-flop 104 is set, the scale controller 144 presets linear motor 50 for low strength operation, e.g. by presetting motor 50 for connection to a relatively low current power source (not shown).

In addition to setting the scale controller 144, the condition of the flip-flop 104 also determines which of AND gates 148, 149, and the like, are enabled and which are disabled. In particular, when the flip-slop 104 is reset the AND gate connected to lead 145, such as gate 148, are disabled, while (by virtue of the effect of an invertor 146) AND gates, such as gate 149, connected to lead 147 are enabled. Conversely, when the flip-flop 104 is set, the AND gates connected to lead 145 are enabled and the AND gates connected to lead 147 are disabled. In this way only those coin-identifying output signals produced by a decoder 158 that are consistent with the preliminary indication of coin resistivity produced by the relay 41 are allowed to pass through the gates 148 and 149. This also permits each output lead of the decoder 158 to be used to identify one or more acceptable denomination of non-magnetic coins in each of the two ranges of resistivity, thereby greatly extending the selectivity of the test for non-magnetic coins. These aspects of the operation of decoder 158 will be more apparent when the device is discussed in detail below.

As the coin 10 approaches the coin starting gate 15, the presence of the coin is detected by an arrival sensor 16. In this embodiment the sensor 16 is an optical sensor including a photoelectric device in one wall of the coin passageway 20. Light from a light source (not shown) in the wall of coin passageway 20 opposite the photoelectric device impinges on the photoelectric device unless it is occluded by the coin 10. The arrival sensor 16 produces an output signal, the level of which indicates whether or not the sensor is occluded. The signal is applied to a delay device 108 in the circuit of FIG. 5. Since sensor 16 is located slightly above the gate 15 in the apparatus of FIG. 3, it will first be occluded before the coin 10 reaches gate 15. The delay device 108 therefore delays any change in the level of the signal applied to it by an interval of time sufficient to allow coin 10 to reach the gate 15 and come to rest. The output signal of the delay device 108 is applied to a gate activator 110 which responds to a signal indicating the presence of a coin by opening the coin gate 15 for an interval of time sufficient to permit coin 10 to pass through the gate 15 and continue along coin passageway 20.

As shown in FIG. 5, the output signals of the delay device 108, flip-flop 106, and flip-flop 102 (inverted by the invertor 120) are all applied to an AND gate 122. The AND gate 122 produces an output signal for setting a normally reset bistable flip-flop 124 when, concurrently, flip-flop 102 is reset, flip-flop 106 is set, and the output signal of delay device 108 indicates the presence of a coin at sensor 16. Because of the presence of the inverter 120, flip-flop 124 can only be set if flip-flop 102 is reset. Accordingly, after the coin 10 has passed through the coin gate 15, only one or the other of flip-flops 102 and 124 can be set. If flip-flop 102 is set (indicating that coin 10 is magnetic), flip-flop 124 cannot be set. On the other hand, if flip-flop 102 is reset (indicating that the coin 10 is non-magnetic), flip-flop 124 will be set if flip-flop 106 is set. Thus flip-flop 124 will only be set if the coin 10 is non-magnetic and of an acceptable resistivity as determined by relay 42, that is, only if the resistivity corresponds to that of a metallic object. The coin 10 is tested as a magnetic coin if flip-flop 102 is set or as a non-magnetic coin if flip-flop 124 is set. Since both of these flip-flops cannot be set concurrently, the coin 10 is tested either as a magnetic coin or as a non-magnetic coin as is appropriate.

It is of course possible for neither of flip-flops 102 and 124 to be set following the opening of the coin gate 15. If coin 10 is neither magnetic nor within the acceptable range of resistivity (i.e. it is non-metallic), neither of these flip-flops will be set and the coin 10 will pass through the apparatus without being subjected to the tests for either magnetic or non-magnetic coins. Without positive results from one or the other of these tests, the coin 10 cannot be identified. Coin 10 is therefore rejected by the coin testing apparatus as unacceptable.

In addition to activating the gate activator 110 and enabling the AND gate 122, the output signal of delay device 108 indicating the presence of a coin at sensor 16 is also used to set a flip-flop 130. While set, flip-flop 130 enables a clock 132 which produces a timing signal consisting of regularly recurring pulses. This timing signal is applied to each of AND gate 134, 136 and 138.

The number of timing pulses passing through each of these AND gates is counted, as will be described in greater detail below, in order to determine the length of time each gate is enabled and therefore the time required for the coin 10 to progress through a corresponding portion of passageway 20.

As mentioned above, the opening of the gate 15 allows the coin 10 to continue down coin passageway 20. As the coin 10 accelerates downwardly under the influence of gravity, it first passes a sensor 11. Like the sensor 16, sensor 11 is a photoelectric device in one wall of passageway 20. As the coin 10 passes it, the sensor 11 traces a path across one face of the coin. Since the sensor 11 is located a predetermined distance from the interior surface or coin track 21 of the passageway 20 with which the edge of the coin 10 is in contact as it proceeds down the passageway, the sensor 11 traces a chord of the circular face of the coin that same predetermined distance from the edge of the coin regardless of the diameter of the coin. The length of this chord is determined by measuring the length of time the sensor 11 is occluded by the coin. Smooth edge coins will slide over the rack 40, which may be provided in this region, without substantial effect on their velocity. Milled edge coins, however, will be slowed by their interaction with the rack 40, thereby providing a means for distinguishing milled edges coins from smooth edged coins of similar dimensions and material characteristics.

The output signal of the sensor 11 is applied to an AND gate 134 as shown in FIG. 5. Normally the level of this signal inhibits the AND gate 134. When the sensor 11 is occluded by coin 10, however, this signal changes to a level which enables the AND gate 134. AND gate 134 therefore begins to pass the timing signal pulses generated by the clock 132 as described above. These timing pulses are counted by a counter 140, which in turn applies a signal representative of the number of timing pulses counted to a decoder 142. When the sensor 11 is no longer occluded (i.e. when the chord described above has been traced across the face of coin 10 and the coin has passed the sensor), the AND gate 134 is again inhibited. The counter 140 therefore stops with a count of timing pulses representing the time taken by the coin 10 to pass the sensor 11. Since all coins start from rest at the gate 15 and accelerate at the same rate (i.e. the gravitational acceleration rate $g$) this final count of timing pulses is uniquely related to the length of the chord traced on the face of coin 10 and therefore to the size of the coin 10. The counter 140 continues to apply a signal representative of the final pulse count to the decoder 142. When the coin 10 reaches the sensor 18 after being subjected to the further tests described below, a further strobe-type signal is applied to the decoder 142. Decoder 142 then compares the final pulse count from the counter 140 with the pulse counts for acceptable coins of several denominations. If the number of pulses counted by the counter 140 is substantially equal to the number of pulses associated with any one or more acceptable coin denomination, the decoder 142 produces a coin-identifying output signal on an output lead associated with that denomination or denominations. The coin-identifying output signal thus generated by the decoder 142 is gated with other coin-identifying signals generated as described below to produce a final coin identification.

After passing the sensor 11, the coin 10 arrives at a sensor 12. If coin 10 is a non-magnetic coin with a resistivity in the acceptable range, flip-flop 124 will be set to indicate that coin 10 is to be tested as a non-magnetic coin. A non-magnetic coin is tested by timing its travel through a linear electric motor.

In the coin selector apparatus in FIGS. 3 and 4, a linear motor 50 is positioned in the vicinity of the coin passageway 20 between sensors 12 and 13. The linear motor 50 is arranged as described above in connection with FIG. 1. Sensors 12 and 13 may each be an optical sensor similar to sensor 16 and 11. An AND gate 150 is enabled because flip-flop 124 is set. Accordingly, when the sensor 12 is first occluded by the coin 10, the output signal of the AND gate 150 changes to a level which sets normally the reset flip-flop 152. In the set condition the flip-flop 152 produces an output signal which enables an AND gate 136 and which also causes a linear motor activator device 154 to start the linear motor 50. The strength of linear motor 50 is, of course, preset by the device 144 as described above. The linear motor 50 brakes or decelerates the coin 10 to an extent dependent on the strength of the linear motor and the product of the resistivity and density of the coin 10. When coin 10 first occludes the sensor 13 on the other side of linear motor 50, the output signal of that sensor resets the flip-flop 152. This disables the AND gate 136 and causes the linear motor activator 154 to switch off the linear motor 50.

The time required for non-magnetic coin 10 to travel from the sensor 12 to the sensor 13 is measured by measuring the time AND gate 136 is enabled. This is accomplished by a counter 156 in the same way that the enabling of AND gate 134 is timed by the counter 140. This pulse count is applied to a decoder 158 which, like the decoder 142, produces a coin-identifying output signal on output leads associate with each of the denominations for which the pulse counts of acceptable coins correspond to this final pulse count.

If the coin 10 is a magnetic coin rather than a non-magnetic coin, the flip-flop 102 rather than flip-flop 124 will be set as the coin 10 passes through the gate 15. Accordingly, the AND gate 150 will be inhibited and none of the non-magnetic coin testing procedures described in the two preceding paragraphs will be initiated when coin 10 first occludes the sensor 12. Instead, the coin 10 is tested by measuring the time taken for the coin to travel from the sensor 17 to the sensor 18 to determine the effect of the magnetic field of the solenoid 60 on the motion of the coin.

When a magnetic coin 10 first occludes the sensor 17, its output signal changes level. An AND gate 160 is enabled by the output signal of flip-flop 102. Accordingly, the change in signal level of sensor 17 is applied to set flip-flop 162, thereby causing that device to change to the set condition. In its set condition, the flip-flop 162 produces an output signal which enables an AND gate 138 and which causes a solenoid activator 166 to activate or energise the solenoid 60. The activation of the solenoid 60 may be delayed slightly by a delay device 264 to allow time for the coin 10 to enter the field of the solenoid 60, thereby avoiding any magnetic acceleration of the coin as discussed above. Once activated, the solenoid 60 retards the coin 10 to an extent determined by the magnetic susceptibility and density of the coin as discussed above. When the coin 10 first occludes the sensor 18 on the other side of the solenoid 60, the flip-flop 162 is reset, thereby disabling the AND gate 138 and de-activating the solenoid 60.

The time required for the magnetic coin 10 to travel from the sensor 17 to the sensor 18 is measured by a counter 168, operating in a manner similar to counters 140 and 156. A decoder 170 produces a coin-identifying output signal on output leads associated with each denomination for which the pulse counts of acceptable coins correspond to this final pulse count.

The occlusion of the sensor 18 causes a momentary change in the level of its output signal which is used to simultaneously strobe decoders 142, 158, and 170. Responsive to this strobe signal, each decoder produces a coin-identifying output signal on those of its output leads associated with the denomination or denominations of coin to which properties of the coin 10 measured by the corresponding timing apparatus substantially compare. These signals are applied to AND gates such as 171, 172 and 173, one of which is associated with each denomination.

If the same acceptable coin is indicated by the decoder 142 and either of the decoders 158 and 170, coin-identifying signals will be concurrently applied to both input terminals of the one of AND gates 171, 172 or 173, associated with that acceptable coin denomination, thereby causing that AND gate to produce a final coin-identifying output signal. In the example of FIG. 5, gate 171 is activated by an acceptable high resistivity non-magnetic coin, gate 172 by an acceptable magnetic coin, and gate 173 by an acceptable low resistivity non-magnetic coin. A final coin-identifying output signal from any of AND gates 171, 172 or 173 enables OR gate 174, thereby causing a gate activator 176 to change the position of a coin gate 70 in the apparatus of FIGS. 3 and 4 from one which would cause the coin 10 to be rejected by the coin testing apparatus to one which allows the coin to be accepted and retained in the apparatus. The coin gate 70 may be a rectangular member 71 which normally allows a coin 10 to pass through the coin testing apparatus to an exit for rejected coins, but which can be pivoted about a shaft 72 to a position (shown in broken lines) in which an acceptable coin 10 is diverted into a branch of passageway 20 leading to a repository for accepted coins.

A final coin-identifying output signal produced by any of the AND gates 171, 172 or 173 is also applied to an accumulator 178 which registers the acceptance of the coin, e.g. by adding its value to the value of any previously deposited acceptable coins. When acceptable coins totalling a predetermined amount have been registered, the accumulator 178 produced an output signal which enables the machine of which the coin testing apparatus is a part, to dispense goods or services worth that amount.

The signal pulse from the sensor 18 is also applied to a delay device 180 which, after an interval of time sufficient for coin 10 to pass the coin gate 70, applied the pulse to a reset device 182. Responsive to this pulse, the reset device 182 restores all flip-flops in the circuit of FIG. 5 to the reset condition and also resets counters 140, 156 and 168 to zero. In this way, the coin testing apparatus is restored to its initial condition and made ready to test another coin.

What is claimed is:

1. A device including a single, nearly vertical coin passageway down which coins can pass;

detecting means for determining whether the coin is made of magnetic or non-magnetic material;

an impeller downstream of the detecting means, the impeller comprising means for generating a magnetic field travelling up the passageway which is energized only when the detecting means detects a non-magnetic coin in the passageway;

a solenoid electromagnet surrounding the coin passageway downstream of the detecting means and arranged to generate a stationary magnetic field only when a magnetic coin is detected by the detecting means; and means for examining the velocity of coins subjected to either of the magnetic fields.

2. A device according to claim 1 in which the detecting means comprises a relay switch having an operating coil, the switch being located on one side of the passageway, the coil being located on the opposite side.

3. A device according to claim 1 in which the switch is arranged to be opened by the presence of a magnetic coin in the passageway between the coil and the switch.

4. A device according to claim 1 including a removable coin-gate located in the passageway upstream of the electromagnet; a sensor arranged to detect the presence of a coin at the gate; means actuated by the sensor for removing the gate; and means for delaying the energising of the electromagnet until after the gate removal means has been energised and the coin has fallen down the passageway from the gate into the region of the passageway where the stationary magnetic field is located.

5. A device according to claim 1 including soft-iron laminae arranged transversely to the passageway at the upstream end of the electromagnet.

6. A device according to claim 1 in which the means for examining the velocity of coins subjected to the stationary magnetic field comprises two sensors, one of the sensors being located in the middle of the region of the stationary magnetic field and the other being located at the downstream end of the said region, and means for measuring the time taken by the coins to pass from one sensor to the other.

7. A device according to claim 1 including means for examining the resistivity of each coin in the coin passageway, determining whether the resistivity of the coin corresponds to that of a metal coin, and controlling the energization of the impeller and the solenoid in accordance with the results of the resistivity examination.

8. A device according to claim 7 in which the resistivity examining means comprises: an oscillating electric source, a coil adjacent the coin passageway connected to the oscillating electric source; and a relay switch having an operating coil which is connected in circuit with the coil that is adjacent the passageway, the relay switch being adapted to be operated when the current through its operating coil exceeds a predetermined level corresponding to the presence of a metal coin in the passageway adjacent the coil.

9. A device according to claim 7 in which the resistivity examining means is arranged to prevent energising of the impeller if the resistivity of the coin in the passageway corresponds to that of a non-metal coin.

10. A device according to claim 7 including a coin gate in the passageway upstream of the impeller and actuating means for removing the gate to allow the coin to fall down the passageway, the resistivity examining means being positioned to examine the resistivity of the coin at the gate before the gate is removed by the gate actuating means.

11. A device according to claim 7 in which the resistivity examining means includes means for determining whether the resistivity of the coin corresponds to a metal coin of relatively high resistivity or a metal coin of relatively low resistivity.

12. A device according to claim 11 in which the resistivity examining means comprises: an oscillating electric source; a coil adjacent the coin passageway connected to the oscillating electric source; and two relay switches each having an operating coil which is connected in circuit with the coil that is adjacent the passageway, the two relay switches being operated respectively by their coils when the currents through their operating coils exceeds two different predetermined levels, corresponding to a metal coin of relatively high resistivity and a metal coin of relatively low resistivity in the passageway adjacent the coil.

13. A device according to claim 11 in which the resistivity examining means selects the value of a characteristic of the travelling magnetic field according to whether a metal coin of high or low resistivity is in the passageway.

14. A device according to claim 13 including two alternative power sources for the impeller and in which the characteristic is the impeller current, the resistivity examining means causing the impeller to be connected selectively to one of the two alternative power sources.

15. A method of testing coins including the steps of allowing a coin to fall down a single, nearly vertical passageway;

conducting a test of the resistivity of the coin in the passageway to determine whether it is magnetic or non-magnetic by passing the coin close to a coil fed with an oscillating current and indicating if the current exceeds a predetermined level;

generating a magnetic field travelling up the passageway with an impeller only if the resistivity test indicates that the resistivity of the coin corresponds to the resistivity of a non-magnetic, metal coin, and examining the velocity of the coin subjected to the travelling magnetic field; and allowing a coin which the test indicates is magnetic to fall through a stationary magnetic field inside a solenoid magnet surrounding the passageway and examining the velocity of the coin subjected to the stationary magnetic field.

* * * * *